United States Patent [19]

Lubov

[11] 4,115,963

[45] Sep. 26, 1978

[54] BUILDING MODULE

[75] Inventor: Donald S. Lubov, San Jose, Calif.

[73] Assignee: Georight Industries, Inc., San Jose, Calif.

[21] Appl. No.: 773,979

[22] Filed: Mar. 3, 1977

Related U.S. Application Data

[63] Continuation of Ser. No. 591,012, Jun. 27, 1975, abandoned.

[51] Int. Cl.[2] ..... E04B 1/32

[52] U.S. Cl. ..... 52/81; 52/DIG. 10

[58] Field of Search ..... 52/80, 81, 82, DIG. 10

[56] References Cited

U.S. PATENT DOCUMENTS

| | | | |
|---|---|---|---|
| D. 204,239 | 4/1966 | Upor | 52/81 |
| 2,938,526 | 5/1960 | Harrison | 52/82 |
| 3,016,115 | 1/1962 | Harrison | 52/82 |
| 3,062,334 | 11/1962 | Henning | 52/81 |
| 3,332,178 | 7/1967 | Foster | 52/70 |
| 3,346,998 | 10/1967 | Nelson | 52/81 |
| 3,374,588 | 3/1968 | Alfrey | 52/81 |
| 3,534,513 | 10/1970 | Atken | 52/70 |
| 3,640,034 | 2/1972 | Shotwell | 52/70 |
| 3,660,952 | 5/1972 | Wilson | 52/90 |
| 3,714,749 | 2/1973 | Atken | 52/70 |
| 3,871,143 | 3/1975 | Quick | 52/82 |
| 3,945,160 | 3/1976 | Grosser | 52/81 |

FOREIGN PATENT DOCUMENTS

| | | | |
|---|---|---|---|
| 285,961 | 6/1964 | Australia | 52/81 |
| 1,170,786 | 11/1969 | United Kingdom | 52/81 |
| 1,244,842 | 9/1971 | United Kingdom | 52/81 |

OTHER PUBLICATIONS

Mathematical Models by Cundy & Rollett Oxford at the Clarendon Press © 1961, pp. 118, 129, Table II.

*Primary Examiner*—Price C. Faw, Jr.
*Assistant Examiner*—Henry Raduazo
*Attorney, Agent, or Firm*—Lowhurst & Aine

[57] ABSTRACT

A building module is formed of a first plurality of isosceles triangular members forming a roof and a second plurality of isosceles triangular members forming walls which support the roof. In one embodiment, some of the triangular members are right triangles and each of the remaining triangular members have two sides which are three-fourths the length of their third side. In another embodiment, all the triangular members each have two of their sides equal in length to three-fourths the length of their third side. Also, each of these embodiments can be combined to produce larger units and can be combined with a partial cubical form to provide vertical walls.

19 Claims, 10 Drawing Figures

BUILDING MODULE

This is a continuation of application Ser. No. 591,012, filed June 27, 1975 and now abandoned.

BACKGROUND OF THE INVENTION

1. Field of the Invention

This invention relates generally to building structures, and more particularly to a building module which is highly versitle and can be combined in a variety of forms to provide many desired configurations.

2. Prior Art

It has long been recognized that the use of triangular panel members for the construction of building structures provides many highly desirable advantages. Building structures formed of triangular panel members have considerably more strength than building structures formed of rectangular panels. Such strength is attributed to the fact that a combination of joined triangular members is equivalent to a truss system, whereas a combination of joined rectangular panels is equivalent to a beam system.

Although many have recognized the advantages of triangular panel members for building structures, other and more important considerations have been overlooked. Generally, most of the prior known building structures of this type employ equilateral triangular panel members in an attempt to achieve greater versitality. In this respect, any side of an equilateral triangular member can be joined with any side of any other equilateral triangular member of the same size. However, the construction of such equilateral triangular panels results in a considerable loss of materials, since generally sheet materials for making such panel members are rectangular in shape. Furthermore, the use of equilateral panel members produces a relatively high cover ratio when employed with a rectangular floor area. That is, the area of the walls and roof of a building structure fabricated of equilateral panel members is generally considerably greater than the rectangular floor area which is covered. This relatively high cover ratio is not desirable for several reasons. A relatively high cover ratio increases the material cost for a given floor area and may also increase the thermal radiation from the enclosed volume.

Examples of building structures which employ equilateral panel members are shown in U.S. Pat. Nos. 3,332,178 and 3,660,952. The structures disclosed in these patents employ equilateral panel members which are joined together to form the walls and roof of a building. It can be appreciated from these patents that when equilateral panel members are employed to form a building structure having a square or rectangular floor area, the resulting structure is of relatively great height as compared to the width and length of its floor area. Furthermore, the skin of such panel members must be cut from a rectangularly shaped sheet of panel material. It can be appreciated that when an equilateral panel is cut from a rectangularly shaped sheet of panel material, a considerable amount of wasted material will remain, thereby increasing the material cost of such a building structure.

The building structures which are disclosed in the above two mentioned patents cannot be easily employed as modular units which can be combined either with each other or with other architectural forms to provide different configurations. That is, a building structure formed of equilateral triangular panel members does not have such relative dimensions which will permit it to be easily joined with other architectural forms.

The cover ratio of a building structure formed of equilateral panel members and having a floor area which is square, such as shown in the above mentioned patents, is 5.2 to 1. Such a relatively high cover ratio is not desirable, since it increases the material costs of the building structure. Furthermore, a relatively large cover ratio is not desirable from the standpoint of thermal efficiency. That is, the greater the cover area as compared to the floor area, the greater will be the amount of heat transmission through the walls and roof of the structure.

SUMMARY OF THE INVENTION

Accordingly, it is an object of the present invention to provide a building module constructed of triangular panel members which has a relatively low cover ratio.

Another object of the present invention is to provide a building module constructed of triangular panel members in which the skin of the panel members can be cut from rectangular sheet material with relatively little loss.

Still another object of the present invention is to provide a building module constructed of rectangular panel members which can be combined with one or more similar building modules or other architectural forms.

These and other objects of the present invention are attained by a building module which is formed of a first plurality of isosceles triangular members which are joined at their base vertexes, each sloping outwardly to form a roof support. A second plurality of isosceles triangular members are joined together to form a roof resting on the first members for support.

A feature of the present invention resides in the provision of such triangular members each having two of their sides being equal to three-fourths the length of their third side. As used in the following description, such triangular members will be referred to as 3-3-4 members. A further feature of the present invention resides in the provision of triangular members which are in the shape of right isosceles triangles in combination with such 3-3-4 triangles to form a building structure.

The invention, however, as well as other objects, features and advantages thereof will be more fully realized and understood from the following detailed description, when taken in conjunction with the accompanying drawings, wherein:

BRIEF DESCRIPTION OF THE DRAWINGS

Like reference numberals throughout the various views of the drawings are intended to designate the same or similar elements.

DETAILED DESCRIPTION OF THE PREFERRED EMBODIMENTS

Figure 1:
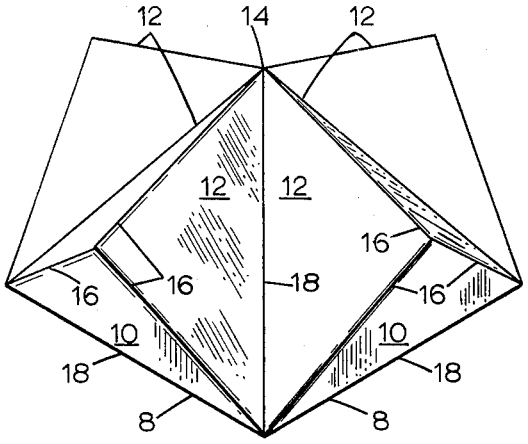
FIG. 1 is a view in perspective of a building module constructed in accordance with the principles of the present invention and formed of right isosceles triangular panel members.

With reference to FIG. 1 there is shown a building module constructed in accordance with the principles of the present invention. The building module illustrated in FIG. 1 has a floor area or base support which is square as shown by the dotted line designated with the reference numeral 8 in FIG. 2. The building module illustrated in FIG. 1 includes four triangular members, two of which are shown in that figure and are designated with the reference numeral 10, and eight triangular panel members six of which are shown in that figure and are designated with the reference numeral 12. A base edge of each of the panel members 10 is coincident with a respective edge of the floor area 8. The panel members 12 are joined together and to the edges of the panel members 10 to form a roof having a apex which is designated with the reference numeral 14. In the embodiment illustrated in FIGS. 1 and 2, all of the panel members 10 and 12 are right isosceles triangles which are equal in size and shape to one another. The edges of the triangular members 10 and 12 which are designated with the reference numeral 16 are equal in length to one another and the edges of the triangular members 10 and 12 which are designated with the reference numeral 18 are equal to one another.

The building module illustrated in FIG. 1 has a cover ratio of 3 to 1. Also, the distance from the floor area to the apex 14 is equal to the length of the edges 16 of the triangular members 10 and 12. In addition, the height of the vertey of each of the triangular members 10 opposite the base edge 18 thereof is equal to two-thirds the height of the apex 14. These relative dimensions permit the building module illustrated in FIGS. 1 and 2 to be combined with other architectural forms as will be better understood from the following description. Since all of the triangular members 10 and 12 are right isosceles triangles, they can be cut from rectangular or square sheet material without any loss of material. That is, any two of the triangular members 10 and 12 can be cut from a square piece of sheet material. Accordingly, no loss of material occurs in cutting the triangular members 10 and 12 from such sheet material.

Figure 2:
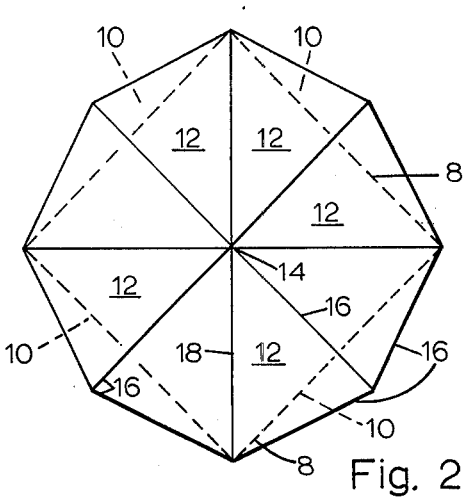
FIG. 2 is a top view of the building module illustrated in FIG. 1.
Figure 3:
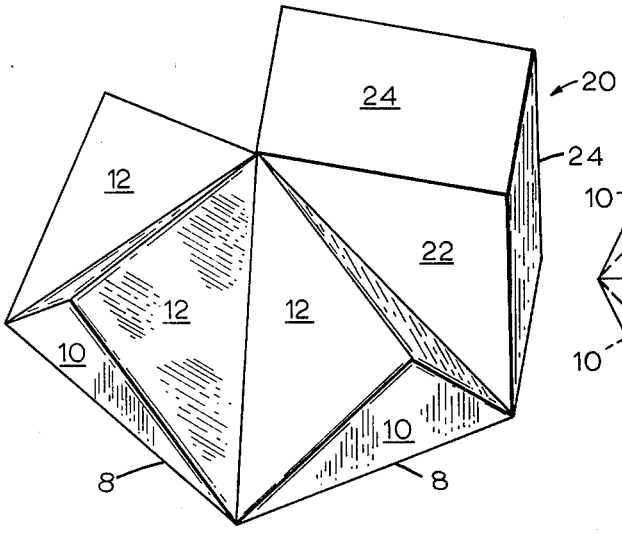
FIG. 3 is a view in perspective of a building module similar to that illustrated in FIG. 1, but combined with another architectural form.
Figure 4:
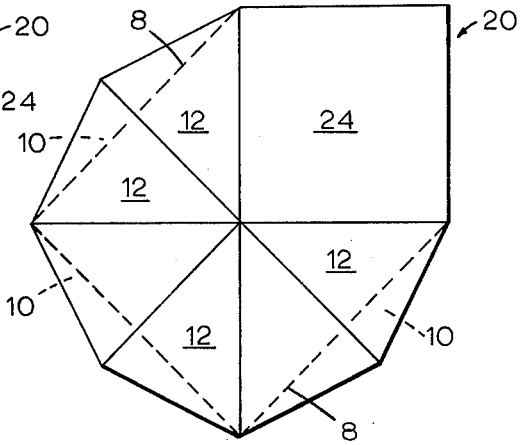
FIG. 4 is a top view of the building module illustrated in FIG. 3.

The embodiment illustrated in FIGS. 3 and 4 combines the structure illustrated in FIGS. 1 and 2 with a partial cubical architectural form which is generally designated with the reference numeral 20. More particularly, by removing one of the panel members 10 and two of its adjacent panel members 12 from the module illustrated in FIG. 1, a partial cubical form can be mated with the remaining panels 10 and 12 to form the structure illustrated in FIGS. 3 and 4. The partial cubical form 20 includes a pair of triangular members, one of which is shown in the drawing and designated with the reference numeral 22, and three square members, two of which are shown in the drawing and designated with the reference numeral 24. Since the shape of the form 20 is cubical, the square panel members 24 are equal in size and shape to two of the triangular members 22 joined together along their longest side. Also, it can be appreciated from the drawing that the triangular panel members 22 are equal in size and shape to the triangular panel members 10 and 12. Accordingly, the partial cubical form 20 can be formed or cut from the same size sheet material which is employed for fabricating the triangular panel members 10 and 12.

Figure 5:
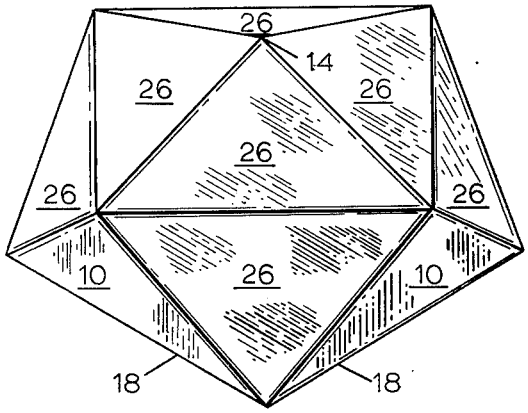
FIG. 5 is a view in perspective of another embodiment of the present invention.
Figure 6:
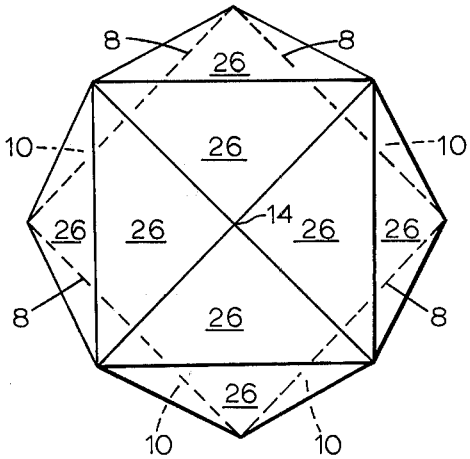
FIG. 6 is a top view of the building module illustrated in FIG. 5.

Still another embodiment of the present invention is illustrated in FIGS. 5 and 6 and includes four panel members 10, two of which are shown in FIG. 5. The base edges 18 of the panel members 10 define a square floor area as shown by the dotted line 8 in FIG. 6. In addition, the building module illustrated in FIGS. 5 and 6 includes eight 3-3-4 isosceles triangles 26. The building module illustrated in FIGS. 5 and 6 is similar to that illustrated in FIGS. 1 and 2 in that the corners of the floor area, the corners of the eaves and the apex 14 are located at the same position. If the panel members 12 are removed and replaced by the panel members 26, the building module illustrated in FIGS. 1 and 2 can be converted to that illustrated in FIGS. 5 and 6. Accordingly, the dimensional relationships discussed above with respect to the building module illustrated in FIGS. 1 and 2 also pertain to the building module illustrated in FIGS. 5 and 6.

Figure 7:
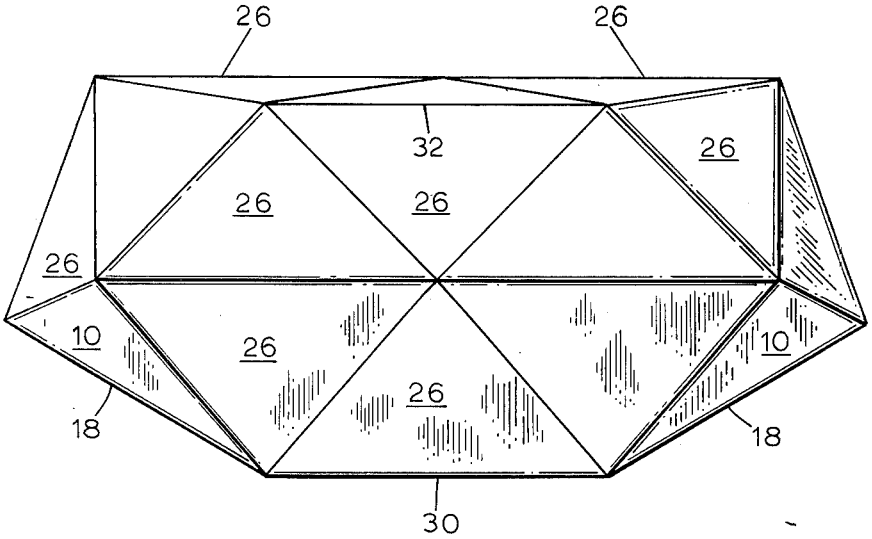
FIG. 7 is a view in perspective of still another embodiment of the present invention.
Figure 8:
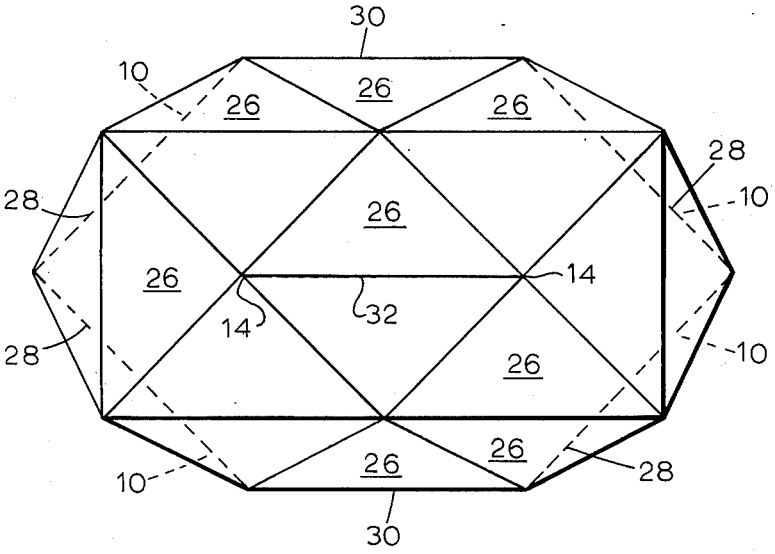
FIG. 8 is a top view of the building module illustrated in FIG. 7.

It can also be appreciated that any two of the panels 12 can be replaced by two of the panels 26 to form a hybrid module having characteristics of both of the modules shown in FIGS. 1 and 3. More particularly, a building module can be formed with six of the panels 12 and two of the panels 26; with four of the panels 12 and four of the panels 26; or with two of the panels 12 and six of the panels 26. Two or more of the building modules illustrated in FIG. 5 can be combined to produce larger structures. A relatively simple illustration of this feature is illustrated in FIGS. 7 and 8. The building structure illustrated in FIGS. 7 and 8 employs four of the triangular members 10 and eight of the triangular members 26 to form walls surrounding the floor area. Also, another eight of the triangular members 26 are employed for forming a roof.

The building structure illustrated in FIGS. 7 and 8, therefore, is formed of exactly the same number of panel members employed in constructing two of the building modules illustrated in FIGS. 5 and 6. However, the cover ratio of the building structure illustrated in FIGS. 7 and 8 is equal to 2.1 to 1. Accordingly, it can be appreciated that as larger combinations of the building modules illustrated in FIGS. 5 and 6 are made, the cover ratio reduces considerably. From the combination illustrated in FIGS. 7 and 8 it can be appreciated that any number of the building modules illustrated in FIGS. 5 and 6 can be combined with one another.

The floor area of the building module illustrated in FIGS. 7 and 8 is defined by the base edges 18 of the panels 10, as represented by the dotted lines designated with the reference numeral 28, and the base edges 30 of two of the panel members 26, as shown in FIG. 8. Also, the roof of the building module illustrated in FIGS. 7 and 8 has two apexes 14 joined by a ridge 32.

Figure 9:
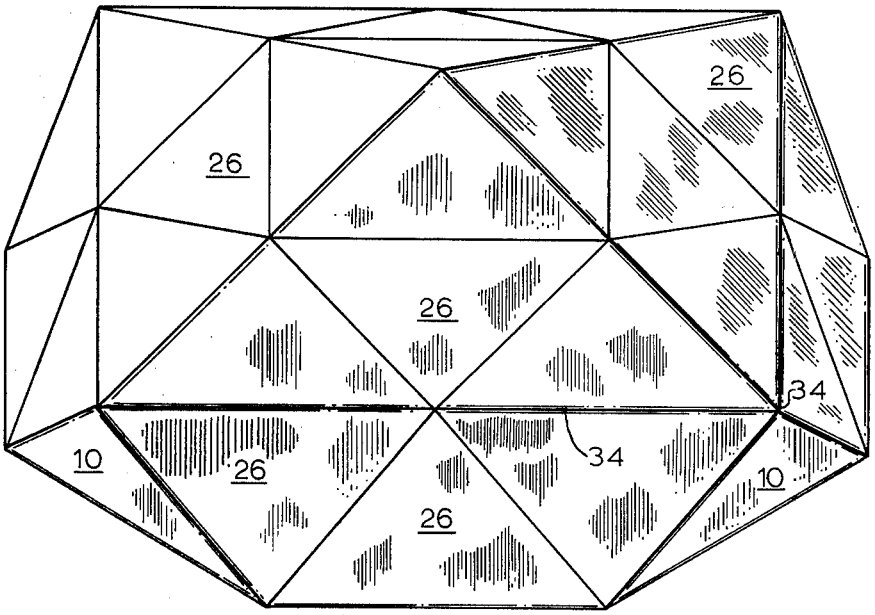
FIG. 9 is a view in perspective of yet another embodiment of the present invention.
Figure 10:
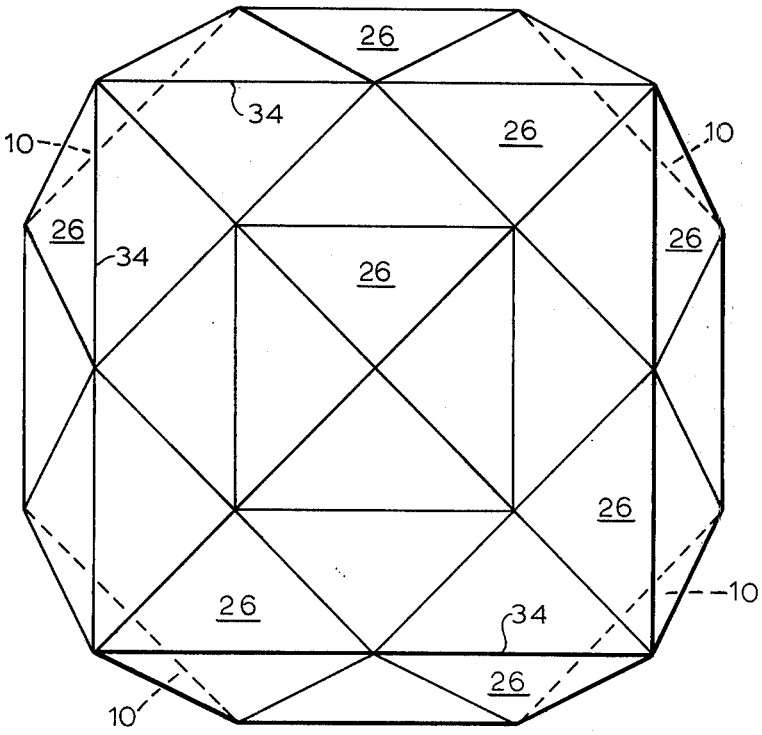
FIG. 10 is a top view of the building module illustrated in FIG. 9.

The building module illustrated in FIGS. 9 and 10 is formed of four of the modules illustrated in FIGS. 5 and 6. More particularly, the building module illustrated in FIGS. 9 and 10 is formed of four of the panel members 10 and 28 of the panel members 26. The building module illustrated in FIGS. 9 and 10 is particularly suited for a two story structure in which a second floor is located at approximately the level of the eaves, which are designated with the reference numeral 34. Also, this building module has a cover ratio equal to approximately 1.75 to 1.

It can be appreciated from the above that the building modules described herein can be combined either with one another or with other architectural forms to provide a large variety of building structures. Also, it can be appreciated that the building modules of the present invention have many advantages which are not attainable with prior known structures.

The invention claimed is:

1. A building module for a building on a support having a preselected maximum height above the support, said module comprising:

a first plurality of substantially identical right isosceles triangular first members, each member having two side edges of a length substantially equal to said maximum height and a base edge resting on said support, said base edges collectively defining an enclosed area, each member sloping upwardly and outwardly and having base vertexes at each end of said base edge for joining the respective base vertexes of the adjacent member, the vertex opposite said base edge of each of said members providing roof support points; and a second plurality of isosceles triangular second members, each second member having two side edges whose length is substantially equal to said maximum height and a base edge, said second members being joined to each other along their side edges with all vertexes opposide said base edges at a common point to form a roof, corresponding vertexes of said second members resting for support on respective ones of said support points, and said common point forming the roof apex having a height above said support which is substantially equal to said maximum height.

2. A building module in accordance with claim 1 in which said second plurality is equal in number to said first plurality.

3. A building module in accordance with claim 2 in which said first plurality comprises the number four.

4. A building module in accordance with claim 1 in which said second members have a base edge whose length is substantially equal to four-thirds of the length of said side edges.

5. A building module in accordance with claim 1 further comprising a further plurality of members for forming wall panels, said further plurality of second members having their side edges joined to corresponding side edges of said first members to form an enclosed space, and door and window openings in selected members.

6. A building module in accordance with claim 3 further comprising four further second members for forming wall panels, said further second members having their side edges joined to corresponding side edges of said first members to form an enclosed space, and door and window openings in selected members.

7. A building module for a building on a support having a preselected maximum height above the support, said module comprising:

a first plurality of substantially identical right isosceles triangular first members, each member having two side edges of a length substantially equal to said maximum height and a base edge resting on said support, said base edges collectively defining an enclosed area, each member sloping upwardly and outwardly and having base vertexes at each end of said base edge for joining the respective base vertexes of the adjacent member, the vertex opposite side base edge of each of said first members providing roof support points; and a second plurality, twice as large as said first plurality, of isosceles triangular second members, each second member having two side edges whose length is substantially equal to said maximum height and a base edge, one-half of said second members collectively defining a roof with corresponding base vertexes resting for support on respective ones of said support points, and the other one-half of said second members and said first members collectively defining an enclosed wall around said enclosed area.

8. A building module in accordance with claim 7 in which said second members are substantially identical to said first members, and in which said second members are paired by joining respective ones along their base edges, each pair having the vertexes opposite the joined base edges connected to respective support points and the side edges below said support points joined to the respective side edges of said first members, the side edges of each pair above said support points being joined to the side edges of the other pairs to form said roof.

9. A building module in accordance with claim 7 in which said second members have a base edge whose length is substantially equal to four-thirds of the length of such side edges, and in which said second members are paired by joining respective ones along their base edges, each pair having the vertexes at the extremity of the joint base edges connected to respective support points and the side edges below said support points joined to the respective side edges of said first members, the side edges of each pair above said support points being joined to the side edges of the other pairs to form said roof.

10. A building module in accordance with claim 7 in which at least two of said second members are substantially identical to said first member and are joined to one another along their base edges, and the vertexes opposite the joined base edges are connected to a pair of adjacent support points, the side edges below said support points being joined to the respective side edges of said first members.

11. A building module in accordance with claim 7 in which at least two of said second members have a base edge whose length is substantially equal to four-thirds of the length of said side edges and are joined to one another along their base edges and the vertexes at the extremity of the joined base edges are connected to a pair of adjacent support points, the side edges below said support points being joined to respective side edges of said first members.

12. A building module in accordance with claim 7 in which at least two of said second members are substantially identical to said first members and are joined to one another along their base edges and the vertexes opposite the joined base edges are connected to a pair of adjacent support points, and in which at least two of said second members have a base substantially equal to four-thirds of the length of said side edges and are joined to one another along their base edges and the vertexes of the extremity of the joined base edges are connected to another pair of adjacent support points.

13. A building module in accordance with claim 12 in which the side edges of such second members below said support points are connected to respective side edges of said first members to form a wall around said enclosed area.

14. A building module in accordance with claim 13 in which the side edges of said second members above said support points are joined to form said roof.

15. A building module in accordance with claim 8 in which said first plurality comprises the number four.

16. A building module in accordance with claim 9 in which said first plurality comprises the number four.

17. A building module for a building on a support having a predetermined maximum height above the support, said module comprising:

at least four substantially identical right isosceles triangular first members, each member having two side edges whose length is substantially equal to said maximum height and a base edge which rests on said support, each member sloping upwardly and outwardly and having vertexes at each end of said base edge, the base edge vertexes of two of said first members being joined to form at least two pairs of first members, and the vertexes opposite said base edge of said first members providing roof support points; and at least sixteen substantially identical isosceles triangular second members having side edges whose length is substantially equal to said maximum height and base edges whose length is substantially equal to four-thirds of the length of said side edges, one of said second members being joined to each pair of said first members such that the vertex opposite its base edge is joined to the common base edge vertex of the pair and the side edges of the second member join the side edges of said pair of first members and defining a wall member, at least three of said second members being joined along their side edges such that the vertexes opposite the base edge of one is joined to the base edge vertexes of the other two to form a wall panel having a long and a short edge in addition to the remaining two side edges, a side edge of a wall panel being joined to the side edge of a pair of first members such that the short edge rests on said support and a vertex on the extremity of said long edge is connected to one of said support points, a roof panel identical to a wall panel being joined to said wall panel along their long sides and the short side of said roof panel forming the roof ridge of the building, and a second member forming a roof member having its base edge joined to the base edge of said wall member and one of its side edges joined to the side edge of a roof panel.

18. A building module in accordance with claim 17 in which each of said wall panels and roof panels is composed of $2n+1$ second members where $n$ is an integer greater than two.

19. A building module in accordance with claim 18 which comprises two pairs of first members, two wall members, two roof members, two wall panels and two roof panels.

* * * * *

UNITED STATES PATENT OFFICE

CERTIFICATE OF CORRECTION

Patent No. 4,115,963 Dated September 26, 1978

Inventor(s) Donald S. Lubov

It is certified that error appears in the above-identified patent and that said Letters Patent are hereby corrected as shown below:

Column 1, line 10; change "versitle" to --versatile--

" line 29; change "versitality" to --versatility--

Column 3, line 11; change "numberals" to --numerals--

" line 31; change "a apex" to --an apex--

" line 45; change "vertey" to --vertex--

Signed and Sealed this

Second Day of January 1979

[SEAL]

Attest:

RUTH C. MASON
Attesting Officer

DONALD W. BANNER
Commissioner of Patents and Trademarks